US006015013A

United States Patent [19]

Edwards et al.

[11] Patent Number: 6,015,013

[45] Date of Patent: Jan. 18, 2000

[54] LIGHTWEIGHT INTERVENTION SYSTEM FOR USE WITH HORIZONTAL TREE WITH INTERNAL BALL VALVE

[75] Inventors: Jeffrey Charles Edwards, Aberdeen; Michael Graham Morgan, Banff, both of United Kingdom

[73] Assignee: Expro North Sea Limited, United Kingdom

[21] Appl. No.: 08/983,050

[22] PCT Filed: Jun. 21, 1996

[86] PCT No.: PCT/GB96/01508

§ 371 Date: May 6, 1998

§ 102(e) Date: May 6, 1998

[87] PCT Pub. No.: WO97/04210

PCT Pub. Date: Feb. 6, 1997

[30] Foreign Application Priority Data

Jul. 15, 1995 [GB] United Kingdom ..... 9514526

[51] Int. Cl.[7] ..... E21B 7/12

[52] U.S. Cl. ..... 166/360; 166/340; 166/344; 166/368

[58] Field of Search ..... 166/368, 360, 166/338, 342–348, 340

[56] References Cited

U.S. PATENT DOCUMENTS

| | | | |
|---|---|---|---|
| 3,189,099 | 6/1965 | Otteman et al. | 166/340 X |
| 3,376,923 | 4/1968 | Bullard | 166/340 |
| 3,536,344 | 10/1970 | Nelson | 166/340 X |
| 3,710,859 | 1/1973 | Hanes et al. | 166/347 X |
| 4,331,203 | 5/1982 | Kiefer | 166/360 X |
| 4,585,369 | 4/1986 | Manesse et al. | 166/340 X |
| 4,848,472 | 7/1989 | Hopper | 166/344 |
| 5,535,826 | 7/1996 | Brown et al. | 166/368 X |
| 5,544,707 | 8/1996 | Hopper et al. | 166/368 X |
| 5,884,706 | 3/1999 | Edwards | 166/368 X |

*Primary Examiner*—Dennis L. Taylor
*Attorney, Agent, or Firm*—Gifford, Krass, Groh, Sprinkle, Anderson & Citowski, P.C.

[57] ABSTRACT

A lightweight intervention apparatus is described for use with a single bore intervention operation and which is suitable for use with a sub-sea horizontal tree with a tree cap and integral ball valve. The lightweight intervention apparatus is adapted to be coupled to the horizontal tree and that when so coupled the integral ball valve within the tree can be actuated via the intervention apparatus and cycled between an open and a closed position. The annulus line within the horizontal tree is adapted to be coupled through the lightweight intervention apparatus to a separate annulus line such that the annulus line is separate from the main bore to facilitate control of the annulus for certain well functions. A significant advantage of this arrangement is that the internal diameter of the main bore is not reduced in any way by apparatus or equipment for separating the annulus line from the main bore so that full bore diameter may be used. The lightweight intervention apparatus includes a horizontal tree connector for mating with the sub-sea horizontal tree, a structural outer housing coupled to the horizontal tree connector and in which is located a sub-sea test tree and an upper top quick connect/disconnect connector which includes a sub-sea test tree latch within a pre-loaded external type connector.

8 Claims, 3 Drawing Sheets

LIGHTWEIGHT INTERVENTION SYSTEM FOR USE WITH HORIZONTAL TREE WITH INTERNAL BALL VALVE

FIELD OF THE INVENTION

The present invention relates to well intervention systems. In particular, the invention relates to intervention systems for use on sub-sea wells with horizontal sub-sea trees.

DESCRIPTION OF THE RELEVANT PRIOR ART

At the present time, the number of well intervention operations on sub-sea wells is relatively few. However, interventions on platform based wells have contributed to considerable increases in production. Therefore, if the cost of sub-sea interventions is reduced there will be a considerable saving to industry.

An area which has a major cost implication in both capital and running costs is the system for monitoring pressure control during intervention on a sub-sea well. In the drilling mode this equipment, for a horizontal tree, comprises a blow out preventer (BOP) stack, a disconnectable lower marine riser package and a marine riser system. For the well intervention through a conventional sub-sea xmas tree a different pressure control system is used, comprising a safety package to contain the well, a disconnectable riser package (EDP) and a dual workover riser system. Both of these arrangements require complex and expensive handling and running system which occupies a large space on board the vessels which may cause problems with regard to storage of other equipment. If a cost effective and economic alternative to a traditional rigged-based BOP system or industry standard workover riser systems can be derived, then this would offer significant advantages.

Accordingly, several major operators are currently reviewing the feasibility of conducting well intervention operations from lightweight semi-submersible and monohull DP vessels for the purposes of well surveillance and management. Cost evaluations of this type of intervention indicate that saving of at least 40–50% are achievable compared with utilising a semi-submersible. If such a vessel could be used it would offer significant advantage in flexibility and speed of manoeuvre to different locations and could also be used for additional uses such as well testing or coil tubing drilling.

Two existing through-BOP stack intervention systems have recently been disclosed; one in applicant's copending U.K. Application No. 9509547.7 for a 5"×2" dual bore completion tree, and the other in U.K. 9505129.8 for a 5" and 7" monobore system for horizontal/spool trees. These BOP stack intervention systems enable completion/intervention operations to be conducted prior to a conventional tree being deployed or, in the case of a horizontal tree, during the completion and intervention phase. Both systems bring considerable advantages to the operator. Such systems are beginning to be deployed in the industry.

Dual bore skeletal workover risers are used in two roles. Firstly, within the marine riser to run and retrieve the well completion etc. Secondly, to deploy the xmas tree and intervention equipment in open water. In both cases the equipment provides the well control functions required in a well invention role.

In addition, with sub-sea horizontal trees it is important that when the lightweight intervention system is coupled to the horizontal tree there is communication between the tree and the lightweight intervention system for both the main bore and the annulus bore so that control of annulus pressure can be carried out for various well control functions. With most proprietary horizontal trees the annulus line within the wellhead exits beneath the internal tree cap. With such proprietary horizontal trees, in order for the annulus line to be separated from the main bore to provide suitable annulus control, a tubing-annulus bridge must be run and installed in the main bore.

However, as disclosed in International Patent Application No. PCT/GB94/02787 a two-part safety valve system for use with a horizontal sub-sea tree is disclosed. A first valve part containing a ball valve is located within the xmas tree with the valve is normally biased to a closed position. The valve remains in the tree at all times during production and can be actuated to an open position by latching in a second separate part, called a valve operator, which contains control cables and a moveable valve actuator operable from the surface during workover to actuate the valve in the wellhead portion to an open position. Such a horizontal tree together with the internal ball valve is manufactured by FMC Limited based at Dunfermline in Scotland.

However, with this arrangement the annulus line passes through the tree and exits at the top of the tree above the internal ball valve.

It is therefore desirable to create a system which would offer all the functions of a through-BOP and open water system and provide a lightweight intervention role, that is one without a BOP stack, which would be suitable for use with a horizontal tree with a tree cap and internal ball valve.

SUMMARY OF THE INVENTION

This is achieved by providing a lightweight intervention apparatus for use with a single bore intervention operation and which is suitable for use with a sub-sea horizontal tree with a tree cap and integral ball valve. The lightweight intervention apparatus is adapted to be coupled to the horizontal tree and that when so coupled the integral ball valve within the tree can be actuated via the intervention apparatus and cycled between an open and a closed position. The annulus line within the horizontal tree is adapted to be coupled through the lightweight intervention apparatus to a separate annulus line such that the annulus line is separate from the main bore to facilitate control of the annulus for certain well functions.

A significant advantage of this arrangement is that the internal diameter of the main bore is not reduced in any way by apparatus or equipment for separating the annulus line from the main bore so that full bore diameter may be used.

The lightweight intervention apparatus includes a horizontal tree connector for mating with the sub-sea horizontal tree, a structural outer housing coupled to the horizontal tree connector and in which is located a sub-sea test tree and an upper top quick connect/disconnect connector which includes a sub-sea test tree latch within a pre-loaded external type connector.

The sub-sea horizontal tree with tree cap and integral ball valve is substantially as disclosed in International Patent Application PCT/GB94/02787 which has been published as International Publication No. WO 95/17578.

The lightweight intervention apparatus includes appropriate hydraulic lines and the like such that when the horizontal tree connector is coupled to the tree the internal ball valve within the horizontal tree can be actuated via the operator coupled to the lightweight intervention apparatus. Thus, the lightweight intervention package may act as a BOP stack providing a barrier for pressure control.

The lightweight intervention apparatus is particularly suitable for use with the dual bore riser disclosed in applicant's co-pending U.K. Patent Application No. 9505129.8 and the sub-sea completion test tree located within the structural housing is provided by a completion tree such as disclosed in applicant's copending U.K. Application No. 9509547.7.

According to a first aspect of the present invention, there is provided lightweight intervention apparatus for use with a sub-sea horizontal tree with an internal ball valve, the horizontal tree having a main bore and a separate annulus bore, the separate annulus bore exiting into the interior of the horizontal tree above the internal ball valve, said intervention apparatus comprising:

first connection means for connecting the lightweight intervention apparatus to said horizontal tree, housing means coupled to said first connection means, second connection means coupled to said housing means, said second connection means having a quick connect/quick disconnect facility, sub-sea completion test tree means located within said housing means in proximity to said second connection means, said first connection means having an internal annulus line which, when said intervention apparatus is coupled to the horizontal tree, is to be coupled to the annulus line exiting into the interior of said horizontal tree, said annulus line when so coupled being separate from the main bore, said lightweight intervention apparatus including ball valve operator means connected to said first connection means for coupling to the horizontal tree whereby when the ball valve operator measure is coupled to the tree the internal ball valve within said tree may be actuated between an open and a closed position by said valve operator through said lightweight intervention apparatus.

Preferably, an annulus valve is located within the annulus line in said intervention apparatus.

According to a second aspect of the present invention, there is provided lightweight intervention apparatus for use with a horizontal sub-sea tree with a tree cap and an internal ball valve, said horizontal tree having a main bore and an annulus bore, said lightweight intervention apparatus comprising:

first connector means for connecting the intervention apparatus to the horizontal tree, housing means coupled to the first connector means at one end and to second connector means at its other end, said second connector means being a quick connect/disconnect connector and being adapted to be so connected to a riser stress joint, said housing means and said first and second connector means defining; an interior main bore of the same diameter as the internal bore of the horizontal tree and a separate annulus line which extends through the lightweight intervention apparatus and which is adapted to be coupled to an annulus line within the horizontal tree when the lightweight intervention apparatus is coupled to the horizontal tree such that there is no communication between the main bore and the annulus bore.

An annulus valve is coupled to the exterior of the housing and is operable to isolate the annulus line. The sub-sea test tree has two spaced ball valves and is identical to that disclosed in U.K. Application No. 9509547.7.

The quick connect/quick disconnect upper housing enables the riser to be pulled from the lightweight intervention apparatus whilst leaving the lower structural housing in place on top of the tree with the sub-sea completion test tree closed to cap the well.

Preferably, the intervention apparatus may include coil tubing clamping and gripping means disposed within said housing, said coil tubing clamping and gripping means being actuatable to clamp coil tubing passing through the main bore in the event of the sub-sea tree being actuated to close the ball valves and cut the coil tubing.

Conveniently, said coil tubing clamping apparatus is provided by a pair of half-shell elements which clamp around the coil tubing.

According to another aspect of the present invention, there is provided a method of intervening in a well which has a sub-sea horizontal tree with a tree cap and internal ball valve in the main bore without using a BOP stack, said method comprising the steps of, providing lightweight intervention apparatus, coupling a valve operator to the leading end of said lightweight intervention apparatus, running said lightweight intervention apparatus and coupling the same to said sub-sea horizontal tree, actuating the internal ball valve in said horizontal tree to an open position by the valve operator via said lightweight intervention apparatus, coupling the annulus line within said horizontal tree to an annulus line within said lightweight intervention apparatus, providing at least one valve in the main bore of said lightweight intervention apparatus, said at least one valve being actuatable between an open and a closed position, and controlling the pressure in the annulus line to permit intervention functions to be carried out in said well.

BRIEF DESCRIPTION OF THE DRAWINGS

These and other aspects of the present invention will become apparent from the following description when taken in combination with the accompanying drawings in which.

DETAILED DESCRIPTION OF THE INVENTION

Figure 1:
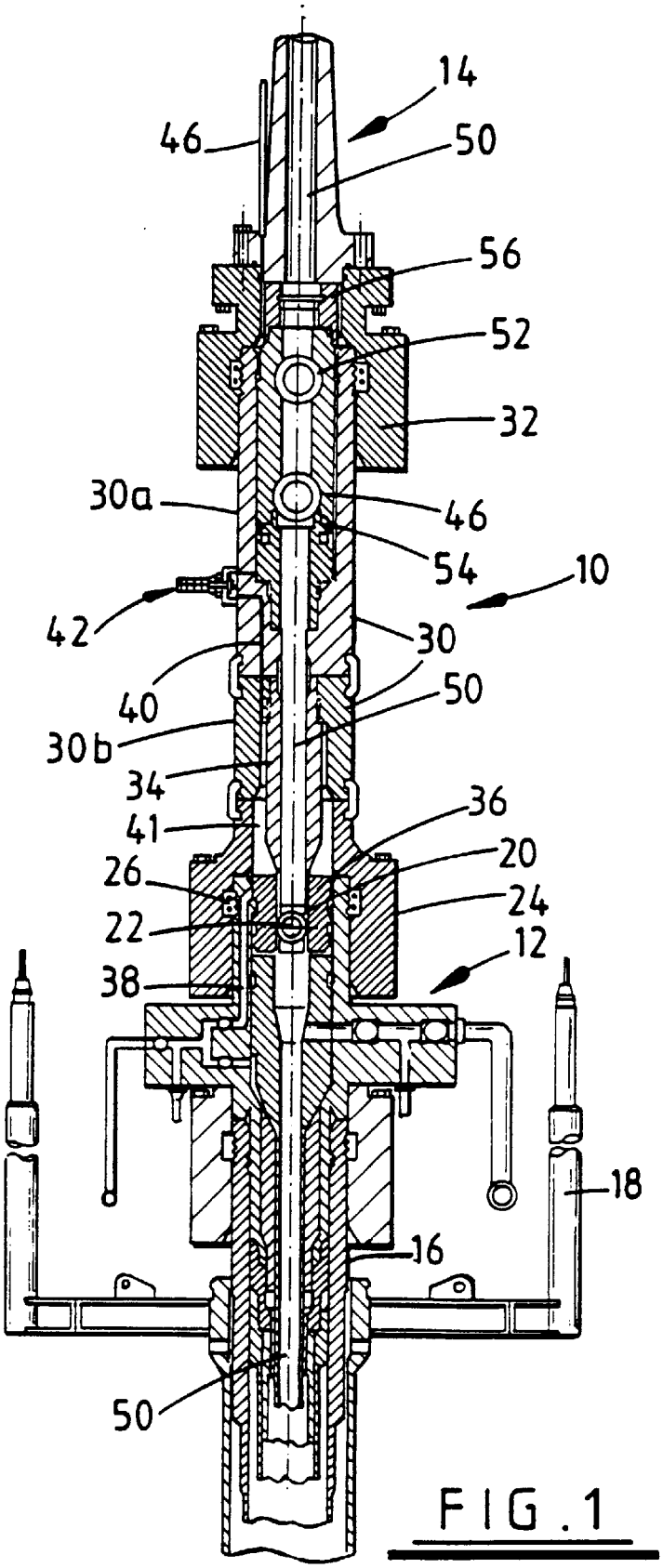
FIG. 1 is a longitudinal sectional view through a wellhead, a sub-sea horizontal tree with a tree cap and an internal ball valve on which is located lightweight intervention apparatus in accordance with a preferred embodiment of the present invention.

Reference is first made to FIG. 1 of the drawings which depicts a lightweight intervention package or apparatus, shown cross-hatched and generally indicated by reference numeral 10, coupled between a horizontal sub-sea xmas tree 12 and a proprietary (Expro Limited) coil tubing riser 14, only part of which is shown in the interest of clarity.

Firstly, it will be seen that the horizontal tree 12 is located on an 18¾" external diameter wellhead 16, only the top part of which is shown, the remainder being located in the sea floor, and the wellhead is shown also coupled to a permanent guide base 18. Located within the tree 12 is an internal ball valve, generally indicated by reference numeral 20, which is shown in a closed position in FIG. 1.

The ball valve 20 is an apertured ball valve having a central through-hole 22 such that when the ball is actuated to an open position by rotating it through 90° the aperture 22 aligns with the main bore 24 of the wellhead and intervention tool. The ball valve 20 is substantially identical to that described in applicant's co-pending published International Patent Application WO 95/17578.

The lightweight intervention apparatus 10 consists first connector 24 which is shown coupled to the tree 12 via collets 26. The first connector 24 is coupled to a main structural outer housing 30 which, in turn, is coupled to an upper quick connect/disconnect connector 32 which, in turn, is coupled to the proprietary Expro riser 14.

Figure 2:
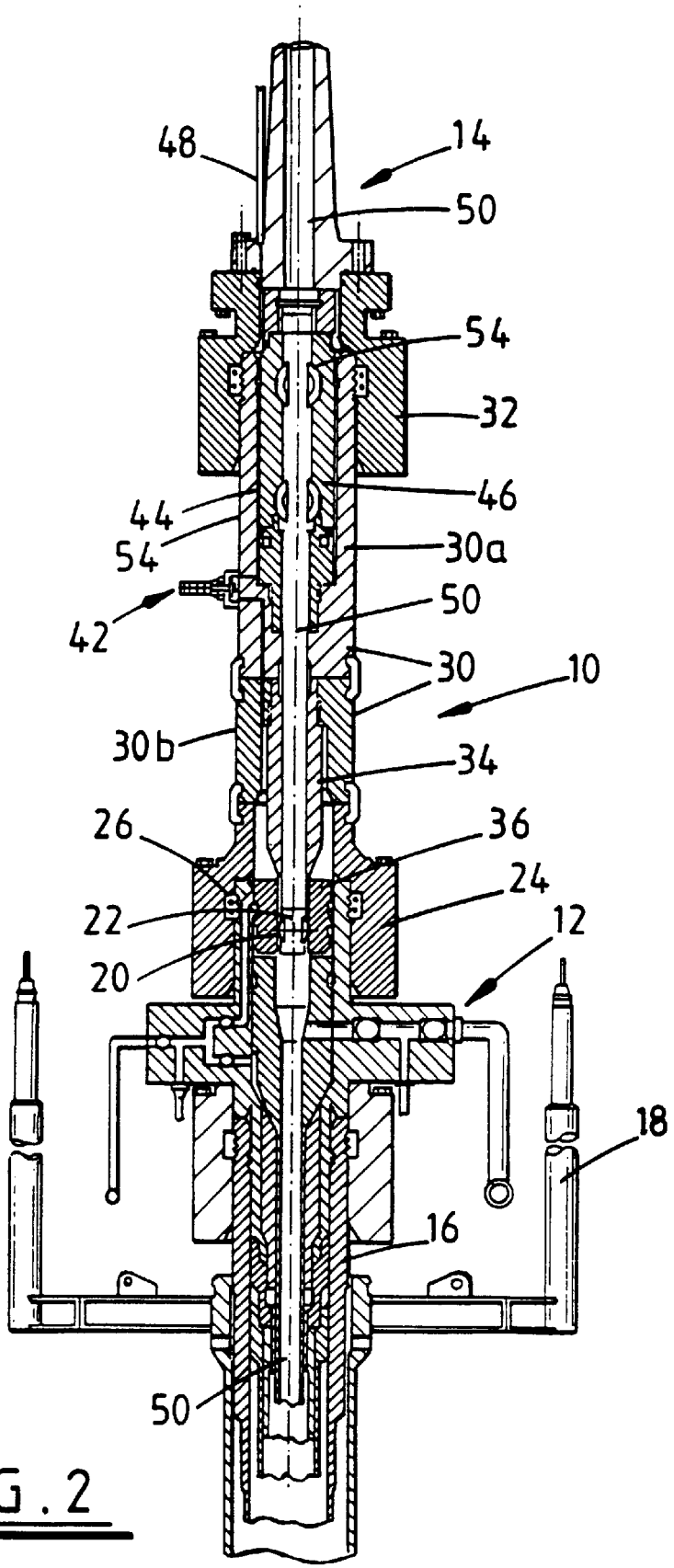
FIG. 2 is a similar view to FIG. 1 and depicts the internal ball valve on the horizontal tree and the ball valves in the sub-sea test tree in an open position.

The lower first connector 24 contains a valve operator, generally indicated by numeral 34, which is substantially identical to that disclosed in the co-pending published International Patent Application WO 95/17578. This operator 34 is carried by the leading end of the housing 30 and once the external tree cap (not shown) is removed and intervention apparatus 10 mates with the xmas tree 12 as shown in FIG. 1. The valve operator 34 engages with the horizontal tree internal tree cap, generally indicated by reference numeral 36, to form the arrangement shown in FIG. 1. It will be noted that in this position the ball valve 20 is still in the closed position. However, the valve operator 34 contains hydraulic lines (not shown in the interest of clarity) which are coupled via the intervention apparatus 10 to the surface such that actuation of the ball valve may be carried out to move the ball valve 20 from the closed to the open position as shown in FIG. 2.

It will also be seen that the lower connector 26 has an annulus line 38 which exits just into the interior of the tree 12 as shown. Similarly, the housing 30 has an internal annulus line 40 which exits into an annular interior space 41 between the housing 30, connector 24 and the valve operator 34.

The annulus line 40 within the housing 30 passes through an annulus valve 42 located at the side of the housing and which is operable from the surface via hydraulic connections (not shown in the interest of clarity). An annular space 44 is defined between an upper part of the housing 30 and the outer surface of a sub-sea test tree 46 disposed within housing 30. The space 44 is connected to the valve 42 and to coiled tubing 48 in the proprietary riser 14, thereby providing a continuous (via valve 42) annulus connection between the tree and the riser and which is separate from the main bore 50.

The sub-sea test tree 46 which is an Expro proprietary test tree is a 7" tree and is substantially the same as disclosed in co-pending application No. 9509547.7, i.e. having two ball valves 52,54 in series. These ball valves are sufficient to cut coil tubing or wireline which may pass through the main bore 50 and thus seal the main bore. The sub-sea test tree 46 is also coupled to a latch 56 in the top connector 32. The connector 32 is an emergency disconnect package (EDP) which can be quickly released from the housing 30 as will be described below. In the event that the well requires to be shut off, not only can the internal ball valve 20 be closed but also ball valves 52,54 in the sub-sea test tree 46, thereby leaving the well sealed.

Reference is now made to FIG. 2 of the drawings which is similar to FIG. 1 but shows the ball valve 20 and test tree valves 52,54 in open position. Ball valve 20 is opened by the operator having actuated the ball valve from surface and similarly valves 52,54 are actuated via hydraulic lines from the surface (not shown in the interests of clarity). It will be seen that in this case the internal main bore 50 of the horizontal tree and the intervention apparatus is substantially the same, that is there is no or minimal reduction of bore diameter with this intervention apparatus. This has a significant advantage in that larger well intervention tools and the like may be run which was hitherto not possible with other proprietary arrangements.

Figure 3:
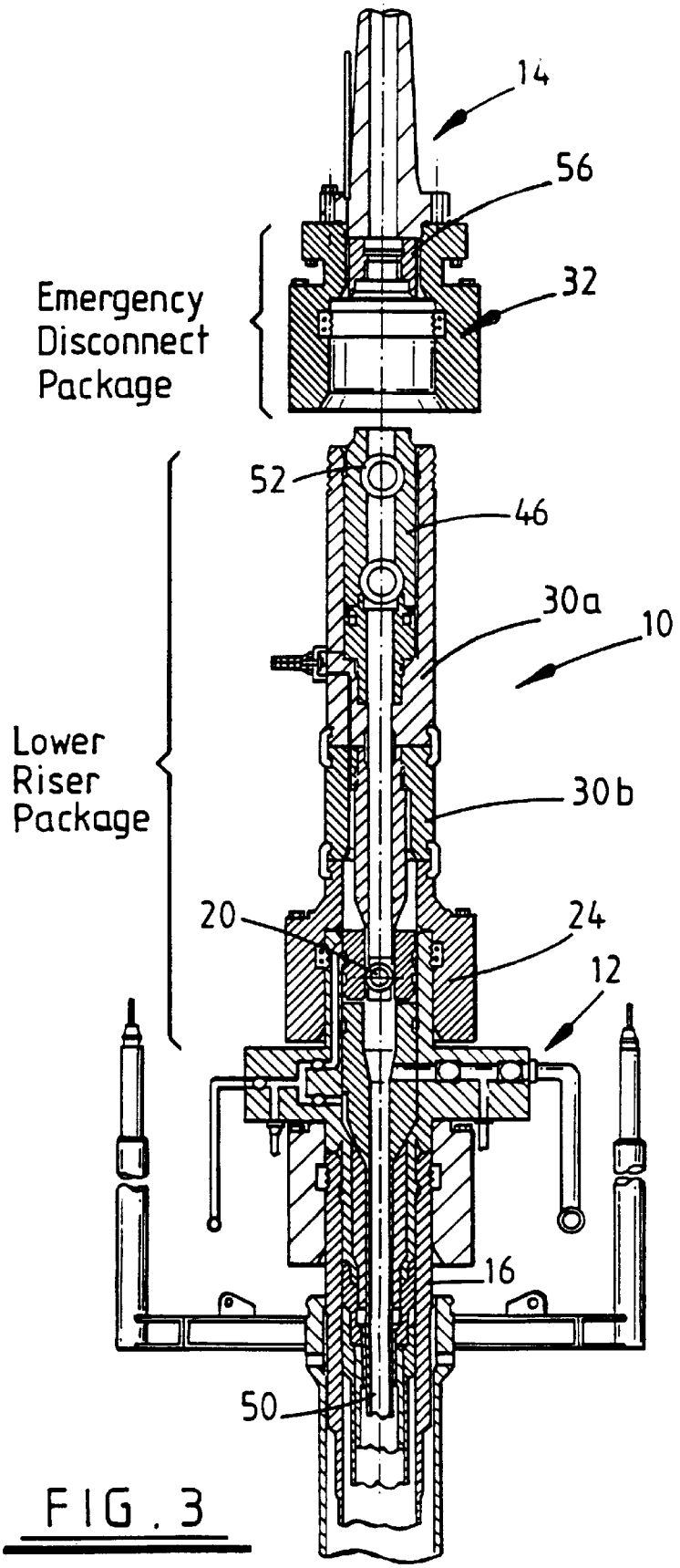
FIG. 3 shows the emergency disconnect package in FIG. 1 disconnected from the lightweight intervention apparatus.

Reference is now made to FIG. 3 of the drawing where it will be seen that the EDP 32 and latch 56, coupled to dual riser 14, is shown separated from the structural outer housing 30 containing the sub-sea test tree 46, and in this case it will also be seen that the valves 52,54 in the test tree 46 and valve 20 in tree cap 36 are in a closed position, thereby effectively sealing the well 50. The housing 30 and lower connector 24 and their contents form a lower riser package and in combination with EDP 32 form the lightweight intervention apparatus.

It will also be appreciated that the various modifications may be made to the apparatus hereinbefore described without departing from the scope of the invention. For example, coil tubing cutting and gripping means may be located within said structural outer housing, although this may mean extending the length of the housing. Such a coil tubing gripping means would be actuated to move to a closed position to grip any coil tubing passing through the main bore in the event that the valves in the sub-sea test tree were actuated which would otherwise cut the coil tubing and leave it free to drop into the well. The coil tubing gripping means would prevent this. The actual coil tubing gripping means are represented by a pair of half-shell elements which are normally separated but which may be moved towards each other using a hydraulically actuated sleeve mechanism (not shown) to grip coil tubing in the main bore once the valve elements within the completion sub-sea test tree are actuated. Once the quick connect/disconnect housing is relatched and the completion sub-sea tree valves re-opened, a fishing tool can then be passed through the riser and main bore to fish the cut tubing and once this has happened the half-shell elements can be retracted for re-use.

Also, it will be understood that the intervention apparatus hereinbefore described may be used on a sub-sea wellhead directly for wells which are already abandoned or which are to be abandoned. In such cases, the horizontal or conventional tree will have already been removed. In such an arrangement the intervention apparatus without the valve operator 36 may be coupled via the lower connecting means directly to the wellhead. For example, on an 18¾" sub-sea wellhead of the CIW type clamp hub design, an 18¾" Cameron type clamp-hub collect connector may be used to attach the intervention equipment to the wellhead. The intervention apparatus may include additional structural elements depending on the intervention operation required. For example, for an abandoned well with gas leakage between annular casings which requires re-cementing, an adaptor spool and cementing block valve assembly is located between the lower connector and the structural housing containing the sub-sea test tree (SSTT) with two ball valves in the main bore. As mentioned above, the SSTT provides primary pressure control barriers and can cut wireline, and an upper emergency disconnect package (EDP) is coupled between the structural housing and the riser. Such interventions can vary depending on the nature or the problem and the basic lightweight intervention package hereinbefore described is flexible and can be used in a number of different situations, although some additional equipment may be required for some particular situations, such as the cementation requirement outlined above.

A principal advantage of this arrangement is that is allows use of the lightweight intervention apparatus with a horizontal sub-sea test tree which has an internal ball valve. Also, separation of the annulus line from the main bore means that the full internal diameter of the main bore can be used which allows larger intervention equipment to be run through the intervention apparatus and the horizontal tree which is not possible with alternative proprietary systems.

The combination of the valve operator and the lightweight intervention apparatus means that the internal valve in the horizontal tree can be actuated as before which provides the existing advantages of this particular tree arrangement.

The separate annulus line and the exterior annulus valve means that control of the annulus can be effected to allow a wide range of intervention functions to be performed, without the limitations of restricting annulus communication.

We claim:

1. Lightweight intervention apparatus for use with a sub-sea horizontal tree with an internal valve, the horizontal tree having a main bore and a separate annulus bore, the separate annulus bore exiting into an interior of the horizontal tree above the internal valve, said intervention apparatus comprising:

first connection means for connecting the lightweight intervention apparatus to said horizontal tree, housing means coupled to said first connection means, second connection means coupled to said housing means, said second connection means having a quick connect/quick disconnect facility, sub-sea completion test tree means located within said housing means in proximity to said second connection means, said first connection means having an internal annulus line which, when said intervention apparatus is coupled to the horizontal tree, is to be coupled to a tree annulus line exiting into the interior of said horizontal tree, said annulus line when so coupled being separate from the main bore, said lightweight intervention apparatus including valve operator means connected to said first connection means for coupling to the horizontal tree whereby when the valve operator means is coupled to the tree the internal valve within said tree may be actuated between an open and a closed position by said valve operator means through said lightweight intervention apparatus.

2. Apparatus as claimed in claim 1 wherein the internal valve is a ball valve.

3. Apparatus as claimed in claim 1 wherein an annulus valve is located within the annulus line in said intervention apparatus.

4. Lightweight intervention apparatus for use with a horizontal sub-sea tree with a tree cap and an internal ball valve, said horizontal tree having a main bore and an annulus bore, said lightweight intervention apparatus comprising:

first connector means for connecting the intervention apparatus to the horizontal tree, housing means coupled to the first connector means at one end and to second connector means at its other end, said connector means being a quick connect/disconnect connector and being adapted to be so connected to a riser stress joint, said housing means and said first and second connector means defining; an interior main bore of the same diameter as the main bore of the horizontal tree and a separate annulus line which extends through the lightweight intervention apparatus and which is adapted to be coupled to a tree annulus line within the horizontal tree when the lightweight intervention apparatus is coupled to the horizontal tree such that there is no communication between the main bore and the annulus bore.

5. Apparatus as claimed in claim 4 wherein an annulus valve is coupled to the exterior of the housing means and is operable to isolate the annulus line.

6. Apparatus as claimed in claim 4 wherein the horizontal sub-sea tree has two spaced ball valves.

7. Apparatus as claimed in claim 4 wherein the housing means further includes an upper housing connected to said quick connect/quick disconnect and a lower structural housing, said housing means being configured to enable the riser to be pulled from the lightweight intervention apparatus whilst leaving the lower structural housing in place on top of the tree with the horizontal sub-sea tree closed to cap the well.

8. A method of intervening in a well which has a sub-sea horizontal tree with a tree cap and an internal ball valve in the main bore without using a BOP stack, said method comprising the steps of, providing a lightweight intervention apparatus, coupling a valve operator to a leading end of said lightweight intervention apparatus, running said lightweight intervention apparatus and coupling the same to said sub-sea horizontal tree, actuating the internal ball valve in said horizontal tree to an open position by a valve operator via said lightweight intervention apparatus, coupling a first annulus line within said horizontal tree to a second annulus line within said lightweight intervention apparatus, providing at least one valve in a main bore of said lightweight intervention apparatus, said at least one valve being actuatable between an open and a closed position, and controlling pressure in one of the first and second annulus lines to permit intervention functions to be carried out in said well.

* * * * *

UNITED STATES PATENT AND TRADEMARK OFFICE

CERTIFICATE OF CORRECTION

PATENT NO. : 6,015,013

DATED : January 18, 2000

INVENTOR(S) : Jeffery Charles Edwards and Michael Graham Morgan

It is certified that error appears in the above-identified patent and that said Letters Patent are hereby corrected as shown below:

Column 8, line 15 - Replace "the" with --an--

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*